US008667635B2

(12) United States Patent
Pianta

(10) Patent No.: US 8,667,635 B2
(45) Date of Patent: Mar. 11, 2014

(54) PORTABLE GROUTING-CLEANING MACHINE FOR CLAD WALLS

(76) Inventor: Cristian Pianta, Legnaro (IT)

( * ) Notice: Subject to any disclaimer, the term of this patent is extended or adjusted under 35 U.S.C. 154(b) by 77 days.

(21) Appl. No.: 13/511,313

(22) PCT Filed: Dec. 15, 2010

(86) PCT No.: PCT/EP2010/069778
§ 371 (c)(1),
(2), (4) Date: May 22, 2012

(87) PCT Pub. No.: WO2011/076633
PCT Pub. Date: Jun. 30, 2011

(65) Prior Publication Data

US 2012/0246849 A1 Oct. 4, 2012

(30) Foreign Application Priority Data

Dec. 21, 2009 (IT) ..... VE2009A0074

(51) Int. Cl.
*A47L 11/29* (2006.01)
*A47L 11/38* (2006.01)

(52) U.S. Cl.
USPC ..... 15/99; 15/51

(58) Field of Classification Search
USPC ..... 15/97.1, 98, 99, 103.5, 22.3, 51; 425/363, 458
See application file for complete search history.

(56) References Cited

U.S. PATENT DOCUMENTS

| | | | | | |
|---|---|---|---|---|---|
| 1,995,685 | A | * | 3/1935 | Perkins | 15/98 |
| 2,142,605 | A | * | 1/1939 | Dawson et al. | 15/99 |
| 2,268,073 | A | * | 12/1941 | Hunn et al. | 15/99 |
| 2,297,107 | A | * | 9/1942 | Magnuson | 15/99 |
| 2,601,690 | A | * | 7/1952 | Georgas | 15/99 |
| 2,930,057 | A | * | 3/1960 | Evans | 15/99 |
| 2,953,798 | A | * | 9/1960 | Borie, Jr. | 15/99 |
| 3,047,894 | A | * | 8/1962 | Sprang | 15/99 |

FOREIGN PATENT DOCUMENTS

| | | |
|---|---|---|
| DE | 3616398 | 12/1986 |
| DE | 4018793 | 12/1991 |
| DE | 19607368 | 10/1996 |

* cited by examiner

*Primary Examiner* — Mark Spisich
(74) *Attorney, Agent, or Firm* — Themis Law

(57) ABSTRACT

A portable grouting-cleaning machine for clad vertical walls includes a frame, an upperly open water container of essentially vertical extension supported by the frame, an endless sponge band stretched between deviation rollers positioned such to form a straight vertical sponge portion to rest against the wall to be treated, the deviation rollers having at least one motorized roller and at least one roller housed in the container, to form a loop of the band therein, two handgrips positioned side by side on the portable frame, and grippable by the operator during the machine operation, and at least one pushbutton, fixed on the frame of machine, connected into the power circuit of an electric motor which drives the motorized roller and is driven by the operator who grips the handles.

23 Claims, 7 Drawing Sheets

PORTABLE GROUTING-CLEANING MACHINE FOR CLAD WALLS

FIELD OF THE INVENTION

The present invention relates to a portable grouting-cleaning machine for clad walls.

BACKGROUND OF THE INVENTION

Grouting, then removing the grout residues from tile-clad masonry walls of any type, comprising bricks, battens or stone blocks, is known to be a slow and laborious operation which is generally carried out manually. In practice, after applying the tiles to a wall, the grout is inserted into the tile gaps then, after this has begun to harden, the grout quantity which has entered the gaps is rendered uniform, and the excess quantity is removed together with the residues which inevitably remain on the tiles.

This operation is generally carried out manually using a sponge or other tools and has proved slow, laborious and uncomfortable, both because of the position which the operator has to assume and because of the need to frequently immerse the sponge in water to remove the grout and to always maintain the sponge in optimum working conditions.

Grouting machines for floor tiles are also known; these comprise a motorized structure provided with wheels for its movement along the floor, and use a movable sponge band stretched between deviation rollers supported by said structure. During its movement the band is passed through a tray containing water which, as the band passes through, regenerates it by removing the grout residues and restores it to a condition to operate via a continuously renewed portion along the gaps in the surface of the floor to be grouted.

One of these known floor tile grouting machines is described in DE 19607368. This machine was thought for working on horizontal surfaces but it could never work on vertical ones, as for doing so it would have to be held by the operator at the required height and made to adhere to the wall during the working phase.

It comprises a structure slidingly movable on wheels and supporting a container for a cleaning liquid at one end. A band of spongy material is provided which absorbs the cleaning liquid and slides about a deviation roller positioned at the other end of the structure, such as to form a portion in contact with the floor. The band also extends through a short distance vertically such as to also operate on that lower strip of the vertical wall generally accommodating the skirting board.

Other examples of floor grouting and cleaning machines are known from U.S. Pat. No. 4,781,556 and DE 3616398.

Although these known machines enable a previously manual operation to be mechanized, they have not proved usable for grouting the cladding of a vertical wall, as their dimensions and weight do not enable an operator to support them in the raised state.

SUMMARY OF THE INVENTION

The invention addresses the problem of mechanizing grouting and cleaning operations on a tiled cladding of a vertical wall, virtually of any height.

This and other objects which will be apparent from the ensuing description are attained, according to the invention, by a portable grouting-cleaning machine for clad vertical walls as described hereinafter.

BRIEF DESCRIPTION OF THE DRAWINGS

A preferred embodiment of the present invention is further clarified hereinafter with reference to the accompanying drawings, in which.

DETAILED DESCRIPTION OF A PREFERRED EMBODIMENT

Figure 1:
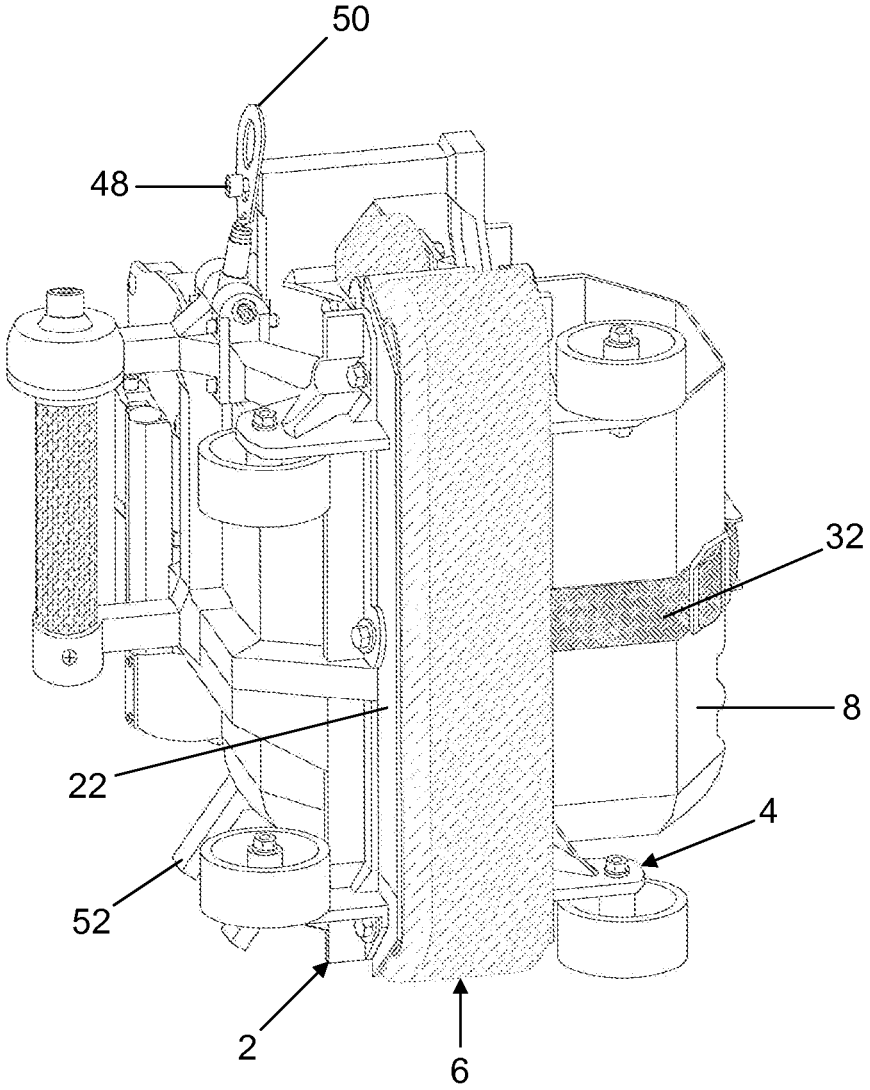
FIG. 1 is a perspective view of the portable grouting-cleaning machine according to the invention.

As can be seen from the figures, the portable grouting-cleaning machine of the invention comprises a frame consisting of two structures 2, 4 separable from each other to enable, in the manner apparent hereinafter, the installation and replacement of an endless sponge band 6 for grouting and cleaning the cladding of a wall.

Given the necessary lightness which a portable device must have, advantageously both the frame structures 2 and 4 are made of at least partly hollow aluminium. These are of overall rectangular shape, with a central passage opening for housing a container 8 containing wash water for the sponge 6, possibly with an added detergent and/or degreasing liquid.

The structures 2 and 4 are connected together by bolts positioned in proximity to the four vertices of the structure and also acting as support and rotation pins for four rollers 10, 12, 14 of horizontal axis. Of these, two rollers 10 are disposed lowerly and are idle, as is that upper roller 12 which when the machine is in operation is closest to the cladding to be grouted and cleaned, whereas the fourth roller 14 is coupled via a speed reducer 16 to an electric motor 18, preferably of low voltage, mounted on the structure 2.

The two structures 2 and 4 are also fixed together by a fifth bolt supporting a fifth roller 20 which is interposed between the upper roller 12 and the underlying lower roller 10, but could also be replaced by a presser slide block.

Pairs of flat elements 22 for guiding the moving sponge band 6, as described hereinafter, are also applied to the said connection bolts for the structures 2 and 4, at the ends of the rollers 10, 12, 14 and 20.

Each of the two structures 2, 4 also supports a pair of first rollers 24 of vertical axis, which together define a vertical plane on which the machine rests against the vertical wall to be grouted and cleaned.

The machine of the invention also comprises a pair of cylindrical handgrips 26 of vertical axis, each applied to one of the two structures 2, 4 and provided upperly with a pushbutton 28 connected to the pushbutton of the other handgrip for operator safety reasons, such that the motor 16 can be powered only if both the handgrips 26 are gripped and the two pushbuttons 28 are operated simultaneously.

The two handgrips 26 are internally hollow both for weight reasons and to enable electric cables to pass through their interior to connect the two pushbuttons 28 to the electric motor 18 and to an external power supply, to which the machine is connected by a cable 30.

The machine of the invention also uses a water container 8, as stated. It consists of a vertically extending upperly open plastic container insertable laterally through an opening provided in the structure 4 and lockable in the correct position by a pair of instantly fitted straps 32.

Figure 2:
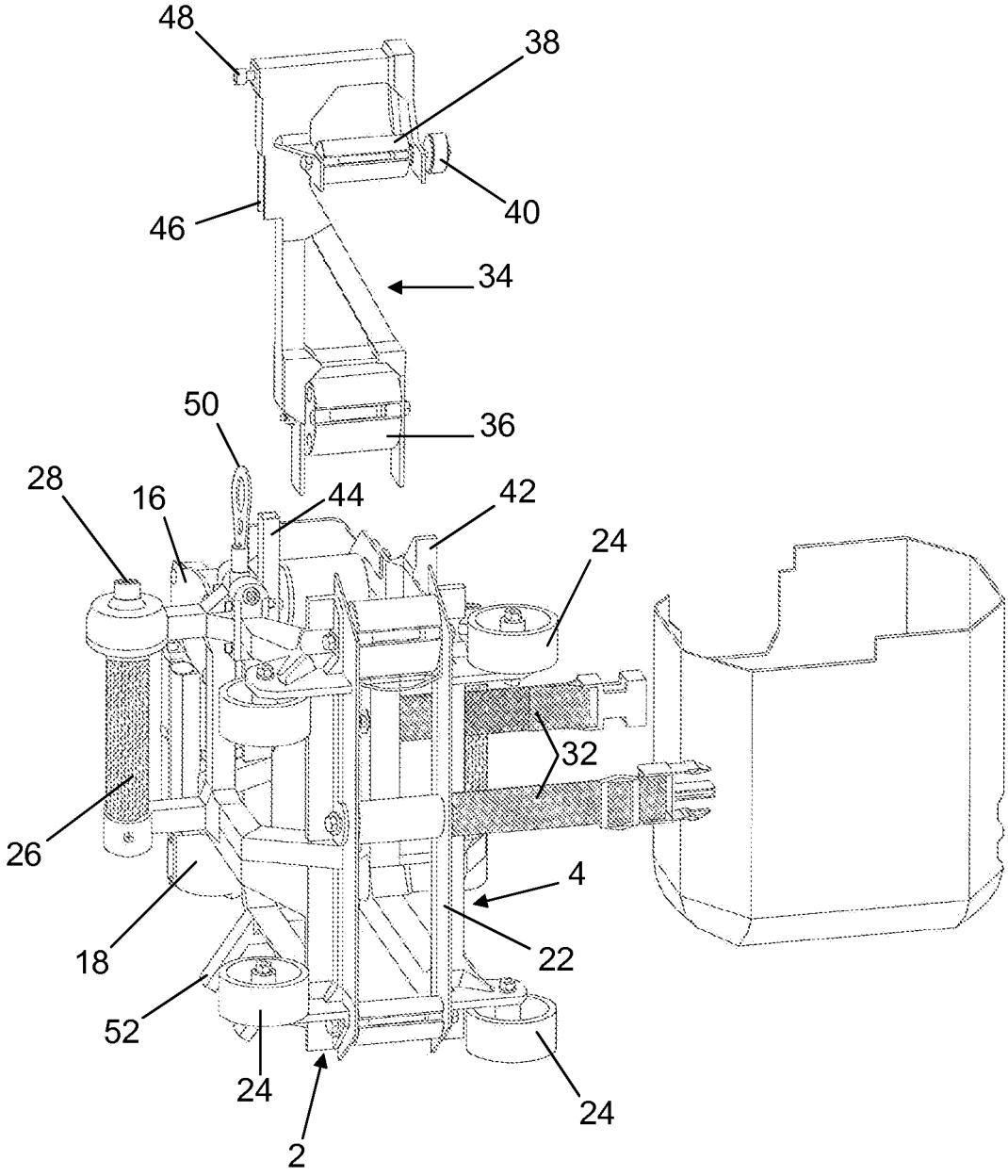
FIG. 2 shows a machine according to the invention in the same perspective view as FIG. 1 but in the exploded state.

The machine frame also comprises a third structure 34, insertable vertically between the two structures 2, 4 when connected together, and well visible in FIG. 2.

This structure 34 essentially consists of an essentially vertical small frame supporting a lower deviation roller 36, an upper squeezer roller 38 and a positioner roller 40.

As stated, the structure 34 is insertable vertically between the two coupled structures 2 and 4, being guided in this insertion by mutually cooperating abutment elements 44, 46. When the structure has been inserted into its working seat, the lower deviation roller 36 is positioned within the container 8, the squeezer roller 34 is positioned in proximity to the non-motorized upper deviation roller 12, and the positioner roller 40 rests on a shoulder 42 provided on the structure 4.

The structure 34 is maintained in its correct operating position by the engagement of a pin 48, provided in the structure itself, in an elastic coupling element 50 fixed to the structure 2.

The two structures 2, 4 are also provided with feet 52 for resting the machine on the ground during operational pauses.

To arrange the machine for operation, when connecting the two structures 2, 4 the sponge band 6, which advantageously consists of a ring with a cloth base and a synthetic sponge coupled to it, is firstly positioned to pass externally about the five rollers 10, 12, 14 and 20. The container 8 is then inserted horizontally through the opening provided in the structure 4 until it can be locked in its seat by the straps 32. Finally the structure 34 is inserted vertically between the two thus coupled together structures 2, 4, such that its lower roller 36 drags the upper portion of the sponge band 6 to form a loop inside the container 8, with the squeezing roller 38 pressing the band against the non-motorized upper roller 12, and the roller of the structure 34 compelling it to remain in this condition by its cooperation with the shoulder 42 of the structure 4.

Figure 3:
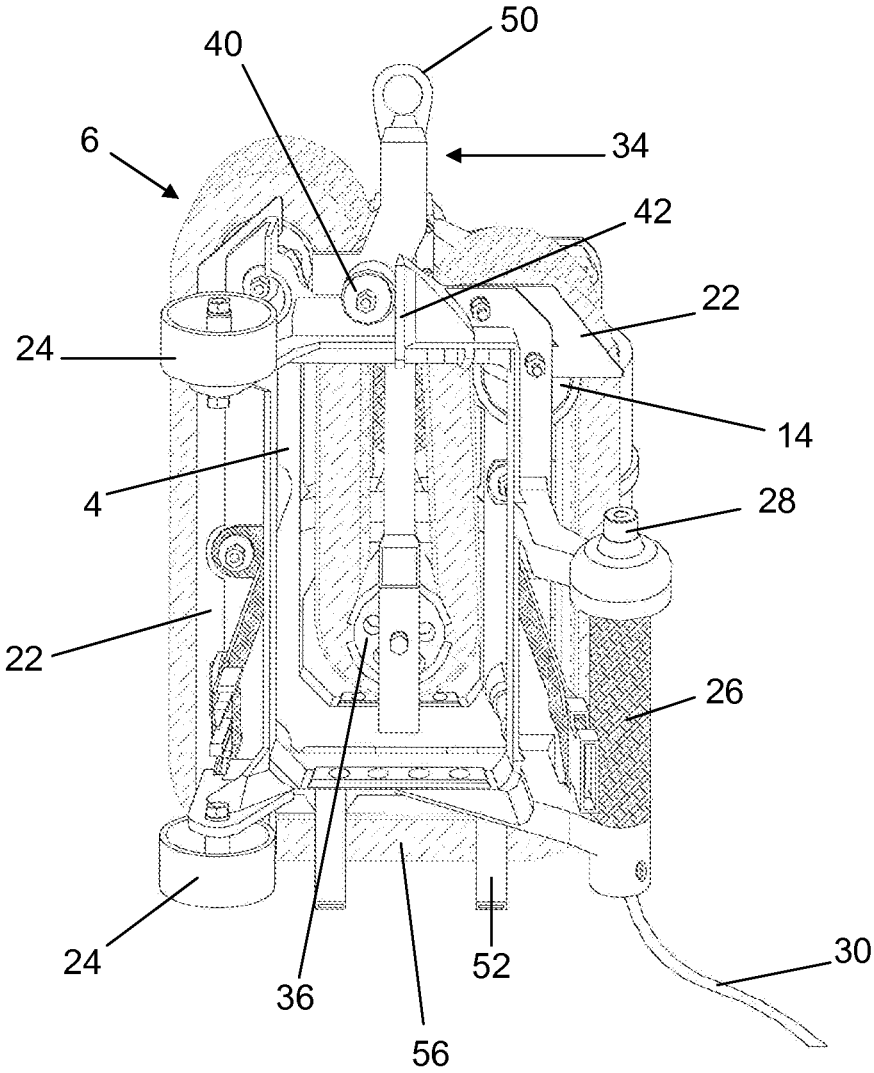
FIG. 3 is a side view thereof with certain parts missing.
Figure 4:
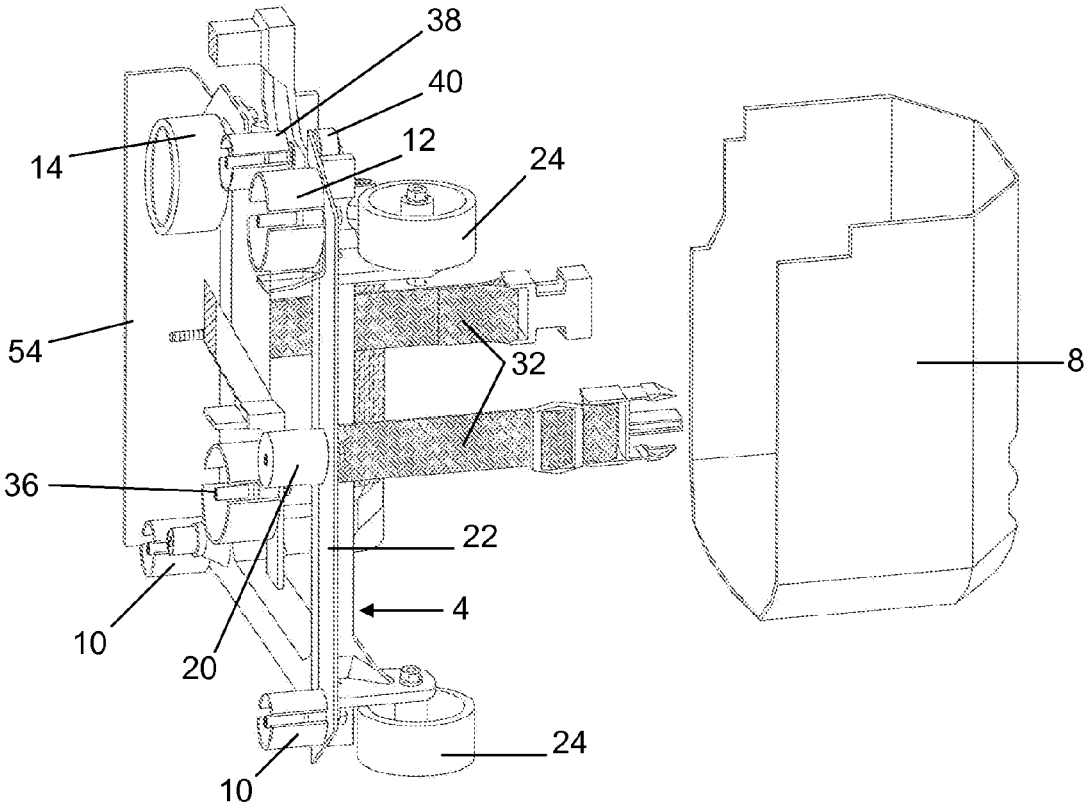
FIG. 4 is a partial perspective view of one of the two structures which form its frame.

The arrangement of the sponge band 6 in this configuration ready for operation is illustrated in FIG. 3 and shows a vertical portion of the band 6 bounded by the non-motorized upper roller 12 and the underlying deviation roller 10 and also defined by the roller 20 interposed therebetween, and slightly projecting from the plane of tangency of the four first support rollers 24.

Figure 5:
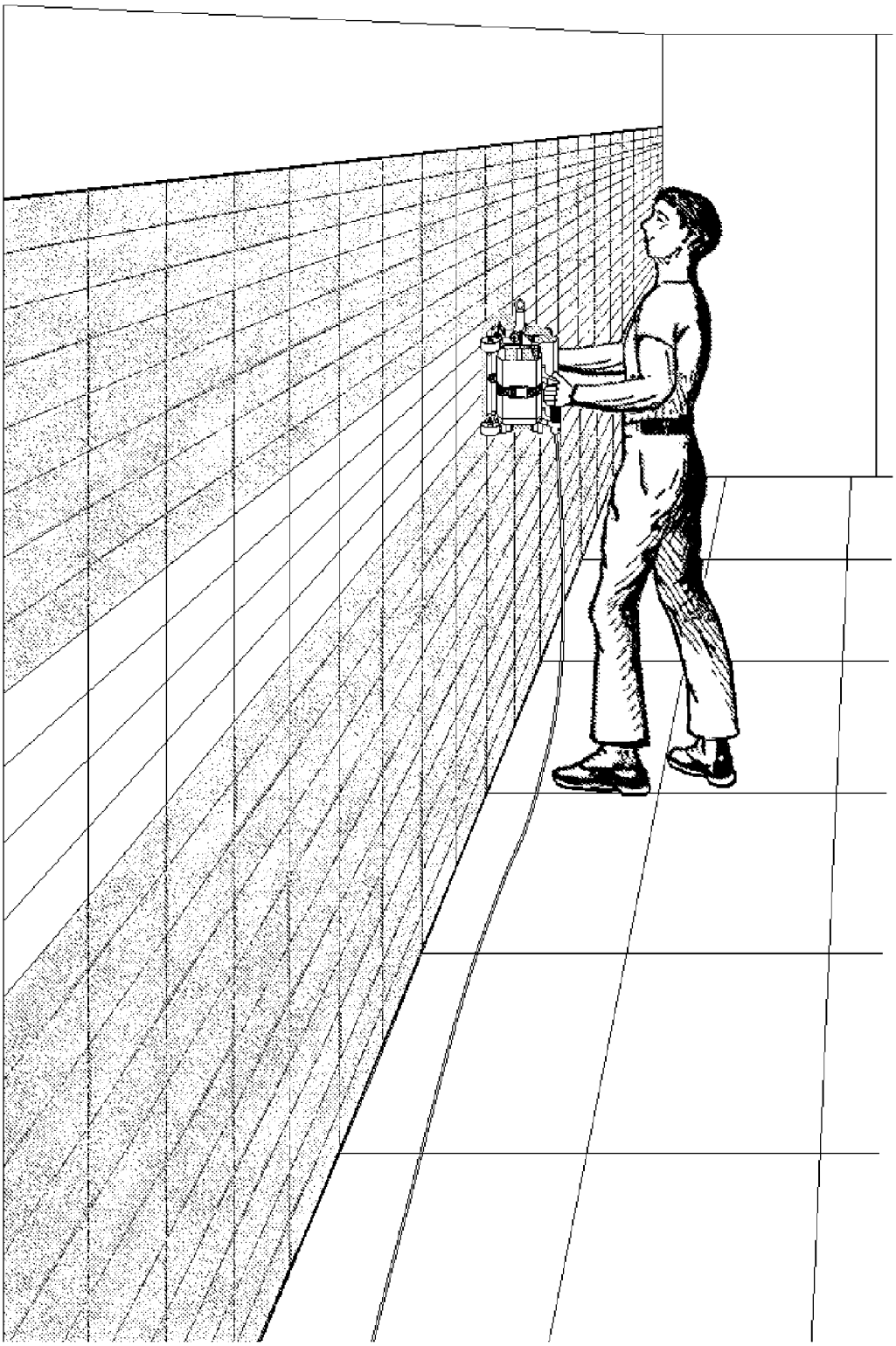
FIG. 5 is a perspective view of the portable grouting-cleaning machine of the present invention, shown being used to clean a clad vertical wall.

When in this state, the operator grips the two machine handgrips 26, and rests the machine against the wall (see FIG. 5), on which the grout has been previously applied along the tile gaps. By simultaneously operating the two pushbuttons 28 the electric motor 18 is powered so that via the reducer 16 it operates the motorized roller 14, which then drives the sponge band 6.

During movement the band 6 is maintained in its seat by the guide elements 22, and with its straight vertical portion maintained pressed against the wall it distributes the grout within the gaps while at the same time removing the excess quantity by dragging it with itself. When, in proceeding along its path, that belt portion which had come into contact with the wall enters the container 8 which has been filled with water, the grout is removed from its surface and the hence regenerated band is squeezed between the two rollers 12 and 38 to again present itself as the straight portion in a condition suitable to continue its function, while the squeezed-out water falls into the container 8.

Moreover, to prevent grout residues removed from the surface under treatment from being able to splash against the operator, and to prevent accidental contact between the operator's fingers and the moving belt 6, the machine is advantageously provided with a protection screen 54 for the vertical rear portion of the machine.

In a different embodiment (not represented in the drawings) the power-supply pushbutton is fixed on the frame and in particular it is situated next to or behind the straight vertical sponge band portion and is automatically driven when the machine is pressed with said portion against the wall to be treated.

From the aforegoing it is apparent that the portable machine according to the invention is extremely advantageous in that it enables the operations involved in grouting and cleaning a cladding to be mechanized, these operations in the past having had to be carried out manually with inevitable operational slowness, operational non-uniformity and operator fatigue. In contrast, the mechanization of this operation has enabled the work to be carried out rapidly, with regularity, without fatigue and under conditions of considerable safety.

The portable machine according to the invention is extremely portable in that its dimensions, weight and structure enable the machine to be easily lifted, transported and supported.

Moreover the portable machine of the invention enables the operator to use the handgrips both for its lifting and for its guiding along the wall to be treated.

In a modified embodiment of the portable grouting machine of the invention, the sponge band 6 provides at the base of the machine a horizontal portion 56 to be rested against a horizontal surface to be treated, for example the surface of a window sill.

Four second rollers 58 of horizontal axis are positioned to the sides of the horizontal portion 56 of the sponge band, to cooperate with the horizontal surface to be treated. In particular, the second rollers 58 define overall a horizontal plane for resting the machine against the horizontal surface to be treated.

In this embodiment there is foreseen a second power-supply pushbutton (not represented in the drawings) fixed on the frame and automatically driven when the machine is laid with its straight horizontal sponge band portion onto the horizontal surface to be treated.

This pushbutton can be situated next to or on top of said straight horizontal sponge band portion.

In this machine the feet 52 are provided with removable extensions 60 such that when these are inserted into the respective feet 52 they define a plane positioned at a lower level than the lower surface of the horizontal portion 56, whereas when these are removed the feet 52 define a plane positioned at a level slightly higher than the plane defined by said second rollers 58, which in its turn is positioned at a slightly higher level than the lower surface of said horizontal portion 56.

Other systems can evidently be provided to adjust the length of the feet 52 and hence the height of the plane defined by their lower ends.

Figure 6:
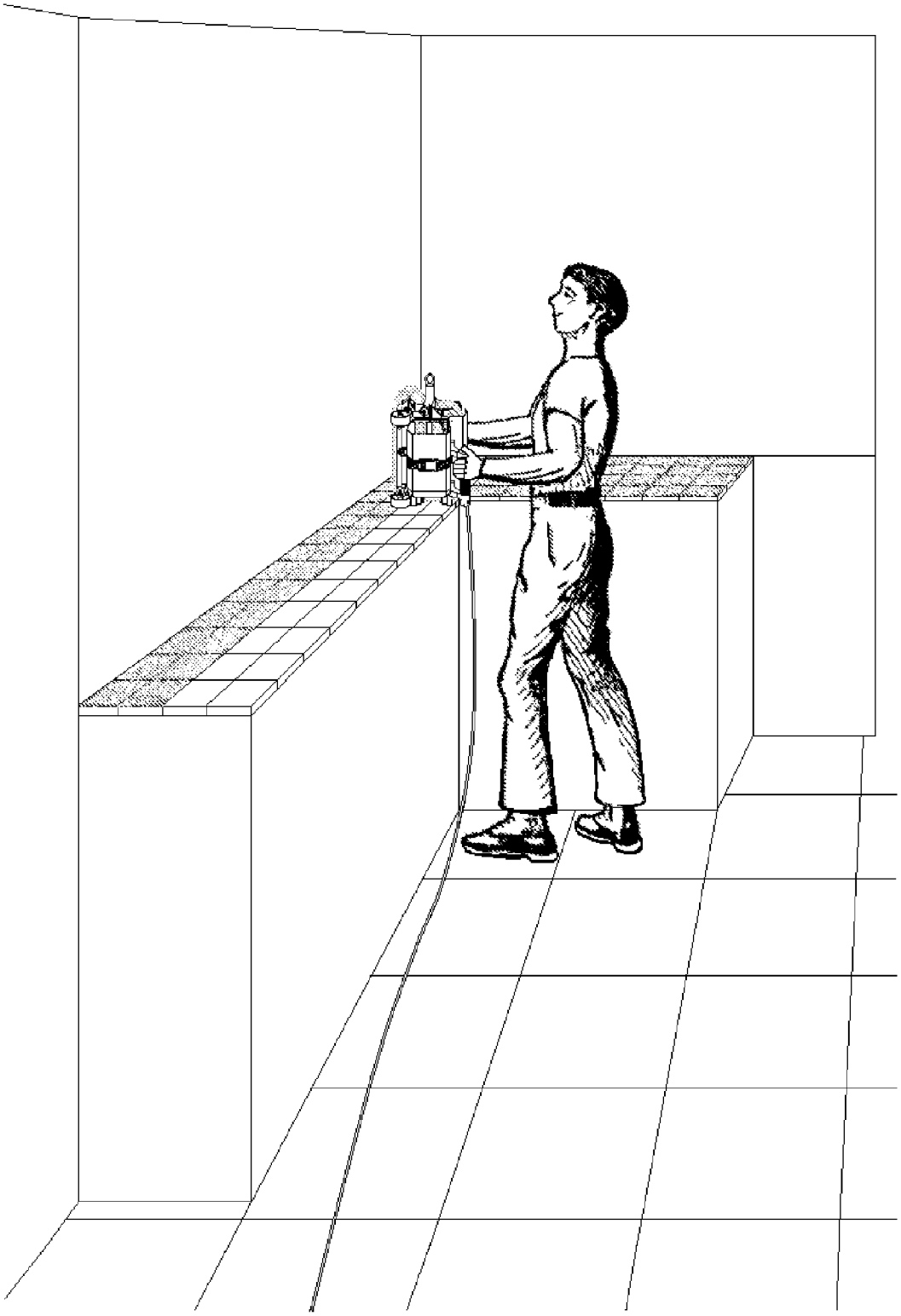
FIG. 6 shows it being used to clean a clad horizontal bench.
Figure 7:
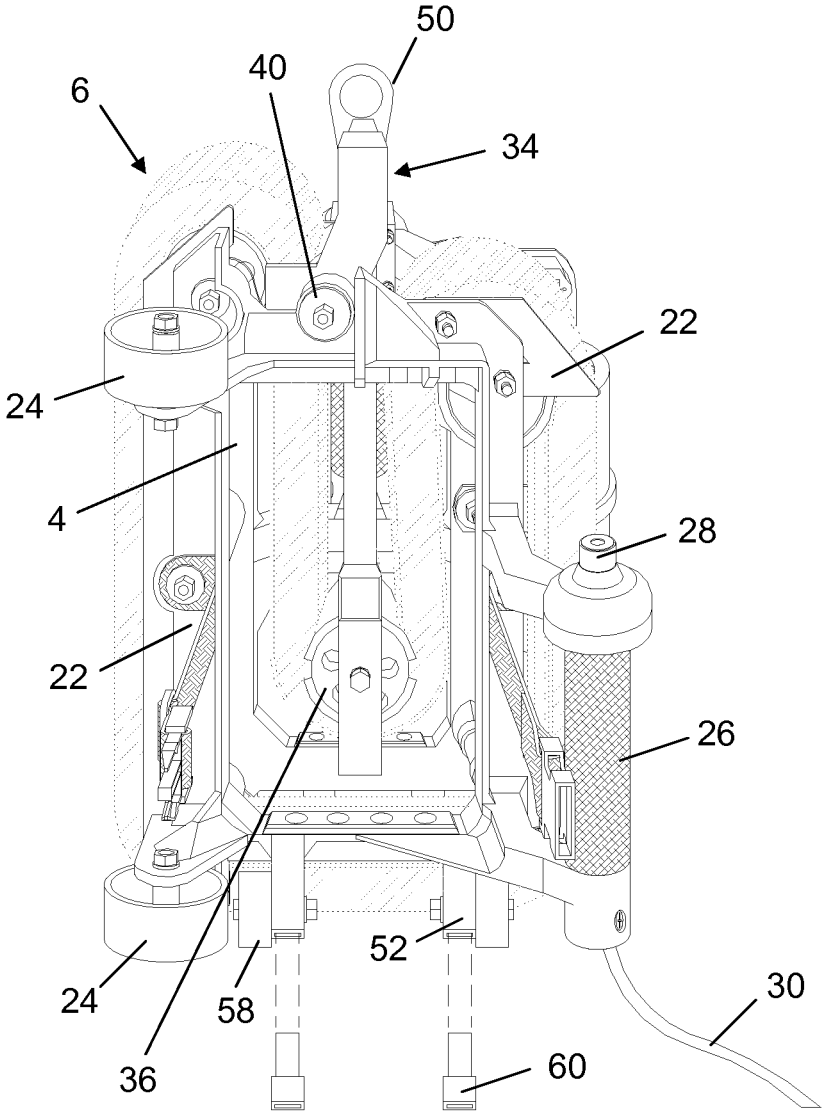
FIG. 7 is a modified embodiment of the portable grouting-cleaning machine of the invention shown in the same view as FIG. 1.

Hence, when the extensions 60 are inserted into the respective feet 52, the machine, intended to operate on a vertical wall, can be rested on the floor during operational pauses, whereas when the extensions are removed the machine is ready to operate on a horizontal surface raised from the floor, such as a window sill or a bench (see FIG. 6).

Hence independently of the type of surface concerned, the machine of the invention can carry out both the grouting of the surface during the grouting stage, and its cleaning, which is particularly effective if a detergent and/or degreasing liquid is added to the water in the container 8.

The invention claimed is:

1. A portable grouting-cleaning machine suitable for clad vertical walls comprising:

a portable frame (2, 4, 34);

an upperly open water container (8) with a prevalent vertical dimension supported by said portable frame;

an endless sponge band (6) stretched between deviation rollers (10, 12, 14, 20, 36) positioned such to form a straight vertical sponge portion to rest against a wall to be treated, said deviation rollers comprising at least one motorized roller (14) and at least one roller (36) housed in said container (8), to form a loop of said band (6) therein;

two handgrips (26) positioned side by side on said portable frame, and grippable by an operator during machine operation to lift, support and guide the machine along a vertical surface to be treated; and at least one pushbutton (28), fixed on the portable frame of the machine, connected into a power circuit of an electric motor (18), which drives said motorized roller (14) and is actuable by the operator who grips said handles (26) during the machine operation.

2. The grouting-cleaning machine as claimed in claim 1, wherein the pushbutton is associated to at least one of said handgrips (26) and is situated in a position accessible to a hand of the operator, which grips the handgrip during the machine operation.

3. The grouting-cleaning machine as claimed in claim 1, wherein the pushbutton is fixed on the frame and is automatically driven when the straight vertical sponge portion of the machine is pressed against the wall to be treated.

4. The grouting-cleaning machine as claimed in claim 3, wherein the pushbutton is situated next to the straight vertical sponge band portion.

5. The grouting-cleaning machine as claimed in claim 3, wherein the pushbutton is situated behind the straight vertical sponge band portion.

6. The grouting-cleaning machine as claimed in claim 1, further comprising at least two first rollers (24) arranged on two sides of the vertical straight portion of said band (6) and cooperating with said wall, the at least two first rollers being arranged such that when said rollers (24) rest on said wall, the straight portion of said band (6) adheres against said wall in a slightly pressed state.

7. The grouting-cleaning machine as claimed in claim 1, wherein said frame (2,4,34) is formed from parts which are assembled together.

8. The grouting-cleaning machine as claimed in claim 1, wherein said frame comprises two parts (2,4) joined together by bolts which also form support pins for the deviation rollers (10,12,14,20), and further comprises a third part (34) removably inserted between the two parts after the two parts have been assembled, the third part supporting the deviation roller (36) housed within said container (8).

9. The grouting-cleaning machine as claimed in claim 8, wherein said third part (34) also supports a squeezing roller (38) cooperating with one of the deviation rollers (12) of said sponge band (6).

10. The grouting-cleaning machine as claimed in claim 9, wherein said third part (34) of the frame supports a roller (40) cooperating with an abutment (42) formed in one of the other two parts (2,4) of the frame, to maintain said squeezing roller (38) adhering to said one of the deviation rollers (12) when said third part (34) is inserted between said other two parts (2,4).

11. The grouting-cleaning machine as claimed in claim 10, wherein said squeezing roller (38) and said one of the deviation rollers (12) cooperating therewith are positioned above said water container (8).

12. The grouting-cleaning machine as claimed in claim 8, further comprising removable elastic coupling means (48, 50) interposed between said third part (34) of the frame and said other two parts (2,4).

13. The grouting-cleaning machine as claimed in claim 8, wherein said water container (8) is insertable between the two frame parts (2,4) when the two frame parts are assembled.

14. The grouting-cleaning machine as claimed in claim 1, wherein the frame (2,4,34) is provided with straps (32) for locking said water container (8).

15. The grouting-cleaning machine as claimed in claim 1, wherein said frame (2,3,34) is provided with feet (52) for resting on a floor during operating pauses.

16. The grouting-cleaning machine as claimed in claim 15, wherein said feet (52) are provided with extensions (60) insertable into the ends thereof.

17. The grouting-cleaning machine as claimed in claim 1, wherein said handgrips (26) extend essentially vertically and are positioned on both sides of the vertical straight portion of the sponge band (6).

18. The grouting-cleaning machine as claimed in claim 1, further comprising a protective screen (54) for that portion of the sponge band (6) close to the handgrips (26).

19. The grouting-cleaning machine as claimed in claim 1, wherein said sponge band (6) further comprises a horizontal portion (56) to be rested against a horizontal surface to be treated, to the sides of said horizontal portion (56) there being positioned at least two second rollers (58) of horizontal axis cooperating with said horizontal surface, the lower surface of said horizontal portion (56) being positioned at a lower level than a plane defined by said second rollers (58).

20. The grouting-cleaning machine as claimed in claim 19, further comprising a second pushbutton fixed on the frame, the second pushbutton being is automatically driven when the machine is laid with the horizontal sponge band portion on a horizontal surface to be treated.

21. The grouting-cleaning machine as claimed in claim 20, wherein the second pushbutton is situated next to the horizontal sponge band portion.

22. The grouting-cleaning machine as claimed in claim 20, wherein the second pushbutton is situated on top of the horizontal sponge band portion.

23. The grouting-cleaning machine as claimed in claim 19, said frame (2,3,34) is provided with feet (52) for resting on a floor during operating pauses, and wherein said feet (52) are adjustable in length, said feet in a lengthened state having lower ends that define a plane positioned at a level lower than a lower surface of said horizontal portion (56).

* * * * *